US011297886B1

(12) United States Patent
Ernst et al.

(10) Patent No.: US 11,297,886 B1
(45) Date of Patent: Apr. 12, 2022

(54) SAFETY VEST WITH FLANGE LIGHT

(71) Applicant: Coast Cutlery Co., Portland, OR (US)

(72) Inventors: Todd Ernst, Portland, OR (US); Brian Sheehy, Los Angeles, CA (US)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 17/212,714

(22) Filed: Mar. 25, 2021

(51) Int. Cl.

| | |
|---|---|
| ***A41D 13/01*** | (2006.01) |
| ***F21V 33/00*** | (2006.01) |
| ***A41D 1/04*** | (2006.01) |
| ***F21Y 115/10*** | (2016.01) |

(52) U.S. Cl.
CPC ..... *A41D 13/01* (2013.01); *A41D 1/04* (2013.01); *F21V 33/0008* (2013.01); *F21Y 2115/10* (2016.08)

(58) Field of Classification Search
CPC ..... A41D 1/04; A41D 13/01; F21V 33/0008; F21Y 2115/10
USPC ..... 362/103–108
See application file for complete search history.

(56) References Cited

U.S. PATENT DOCUMENTS

| | | | | |
|---|---|---|---|---|
| 5,249,106 | A * | 9/1993 | Barnes | G08B 5/004 362/103 |
| 6,059,414 | A * | 5/2000 | Tsai | A41D 13/01 359/516 |
| 7,377,663 | B2 * | 5/2008 | Desjardin | A41D 13/01 362/103 |
| 7,758,200 | B2 * | 7/2010 | Tuan | F21V 33/0008 362/103 |
| 2011/0084630 | A1 * | 4/2011 | Cheng | A43B 1/0072 315/313 |
| 2011/0199779 | A1 * | 8/2011 | Chu | F21V 33/0008 362/551 |
| 2021/0153574 | A1 * | 5/2021 | Greszler | G08B 21/16 |

OTHER PUBLICATIONS

Global Glove; FrogWear HV Premium Surveyors LED Vest—GLO-12LED; Accessed on Mar. 16, 2021 from https://www.globalglove.com/frogwear-hv-lightweight-mesh-safety-led-vest-glo-12led; 2 pages.
Global Glove; FrogWear HV Premium Surveyors LED Vest—GLO-15LED; Accessed on Mar. 16, 2021 from https://www.globalglove.com/frogwear-hv-premium-surveyors-led-safety-vest-glo-15led; 2 pages.
Nite Beams; Hi Vis LED Safety Vest—Class 2—Public Safety; Accessed on Mar. 16, 2021 from https://www.hitebeams.com/product/hi-vis-yellow-5-pt-breakaway-class-2; 2 pages.

(Continued)

*Primary Examiner* — Jason M Han
(74) *Attorney, Agent, or Firm* — Schwabe Williamson & Wyatt, P.C.

(57) ABSTRACT

A safety vest includes a vest body having front, back and sides, a light source, including a battery pack with at least one LED and a light flange, the light flange comprising a flat member mounted in proximity to the at least one LED such that light shining from the LED onto the flat member will light up the flat member, wherein the light source is removably mounted to the vest body such that the flat member provides a safety light mounted to the vest.

9 Claims, 10 Drawing Sheets

(56) References Cited

OTHER PUBLICATIONS

Portwest; Portwest Orion LED Executive Vest—L476; Accessed on Mar. 16, 2021 from https://www.cabletiesandmore.com/led-executive-safety-vest-orion?bid=19704&gclid=Cj0KCQiAv6yCBhCLARIsABqJTjbyV7UOb1FKfDxdvPbKNFpSPrJ3nGe-SVVWOZbp7TXZZ6W0ppWgEKgaAIJkEALw_wcB; 2 pages.
Superior LED; Illuminated LED Safety Vest With NO ID Panel; Accessed on Mar. 16, 2021 from https://www.buysuperiorled.com/vestnoid.html; 2 pages.
Uline; LED Hi-Vis Safety Vest; Accessed on Mar. 16, 2021 from https://www.uline.com/BL_1143/LED-Safety-Vest; 1 pages.
Uvex; Uvex Protection Active Flash; Accessed on Mar. 16, 2021 from https://www.uvex-safety.com/en/product-group/uvex-protection-active-flash-safety-through-active-lighting/; 3 pages.

* cited by examiner

SAFETY VEST WITH FLANGE LIGHT

TECHNICAL FIELD

The present disclosure relates generally to the field of safety vests.

BACKGROUND

Safety vests have been used for many years. They typically are fabricated from reflective material or have reflective sashes or bands so that drivers coming upon workers will see the reflecting vest and avoid a collision. Such vests are also often worn by joggers, walkers, bicycle riders and others traveling or working on or close to roads where vehicles will be driving. Reflective vests are often effective in warning drivers about the presence of workers. However, even with reflective material prominently placed on safety vests, they may not make the person wearing the vest as visible as if it was daytime. Moreover, vests often get dirty, which can reduce the reflective capability of the vests. Also, in certain settings vests might be used where the party coming upon the worker might not have a light to render the reflective material visible. For example, runners, bicycle riders or even walkers coming up on someone in a reflective vest might not be using a light to shine on the reflective material. Therefore, the safety vest might be ineffective to avoid a collision.

One approach to overcome these issues has been to provide LED buttons that provide an active light source and thus alert the driver or person coming up on someone having such a vest that someone is in their travel path. While such buttons or the like may provide some assistance, they have not proven much more effective than a vest bearing prominent reflective material.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION

Figure 1:
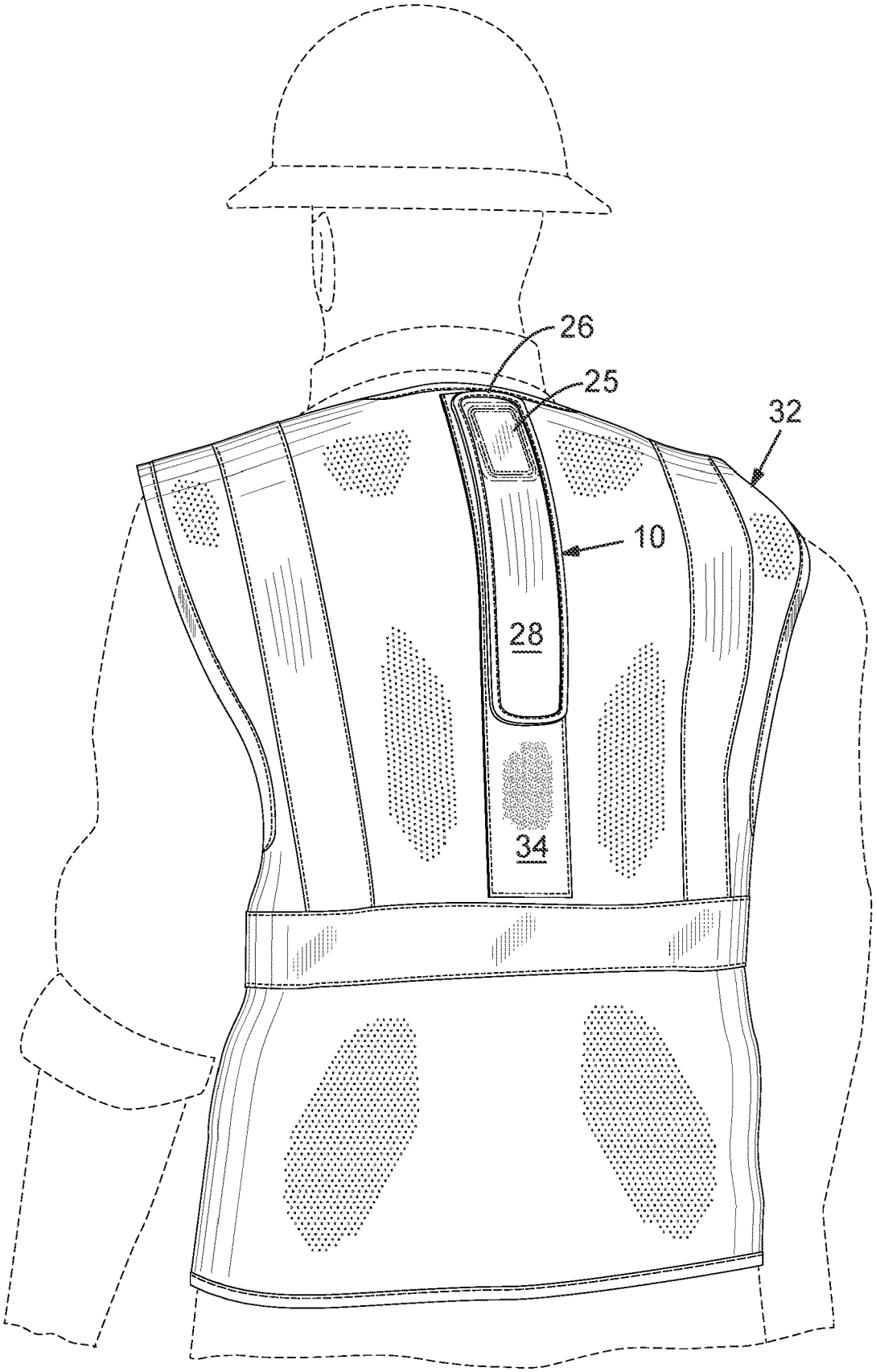
FIG. 1 is a perspective view of a person wearing an embodiment of the vest, with the flange light in place.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

One aspect of the invention provides a safety vest includes a vest body having front, back and sides, a light source, including a battery pack with at least one LED and a light flange, the light flange comprising a flat member mounted in proximity to the at least one LED such that light shining from the LED onto the flat member will light up the flat member, wherein the light source is removably mounted to the vest body such that the flat member provides a safety light mounted to the vest.

The light source may be removably mounted into a pocket in the vest body such that a layer of at least translucent fabric is disposed over the flat member when the light source is mounted in the vest body.

The flat member may be a transparent piece of plastic having a portion that extends into the light source adjacent to the at least one LED. The flat member may be mounted to the vest body by Velcro. The flat member may be elongate and may include a narrower portion that extends into the light source.

Another aspect of the invention provides a light for illuminating a safety vest, the light including a light source having including a battery pack with at least one LED and a light flange, the light flange comprising a flat member mounted in proximity to the at least one LED such that light shining from the LED onto the flat member will light up the flat member, and a pocket into which the light source may be removably inserted, the pocket including an open end and a closed end, one side having a covering thereon that is at least translucent, and one side having a removable mounted system thereon for removably mounting the pocket to a safety vest.

Again, the flat member may be elongate with a narrowed portion that can extend into the battery pack to a point adjacent the LED.

The removable mounting system may be in the form of Velcro.

Figure 2:
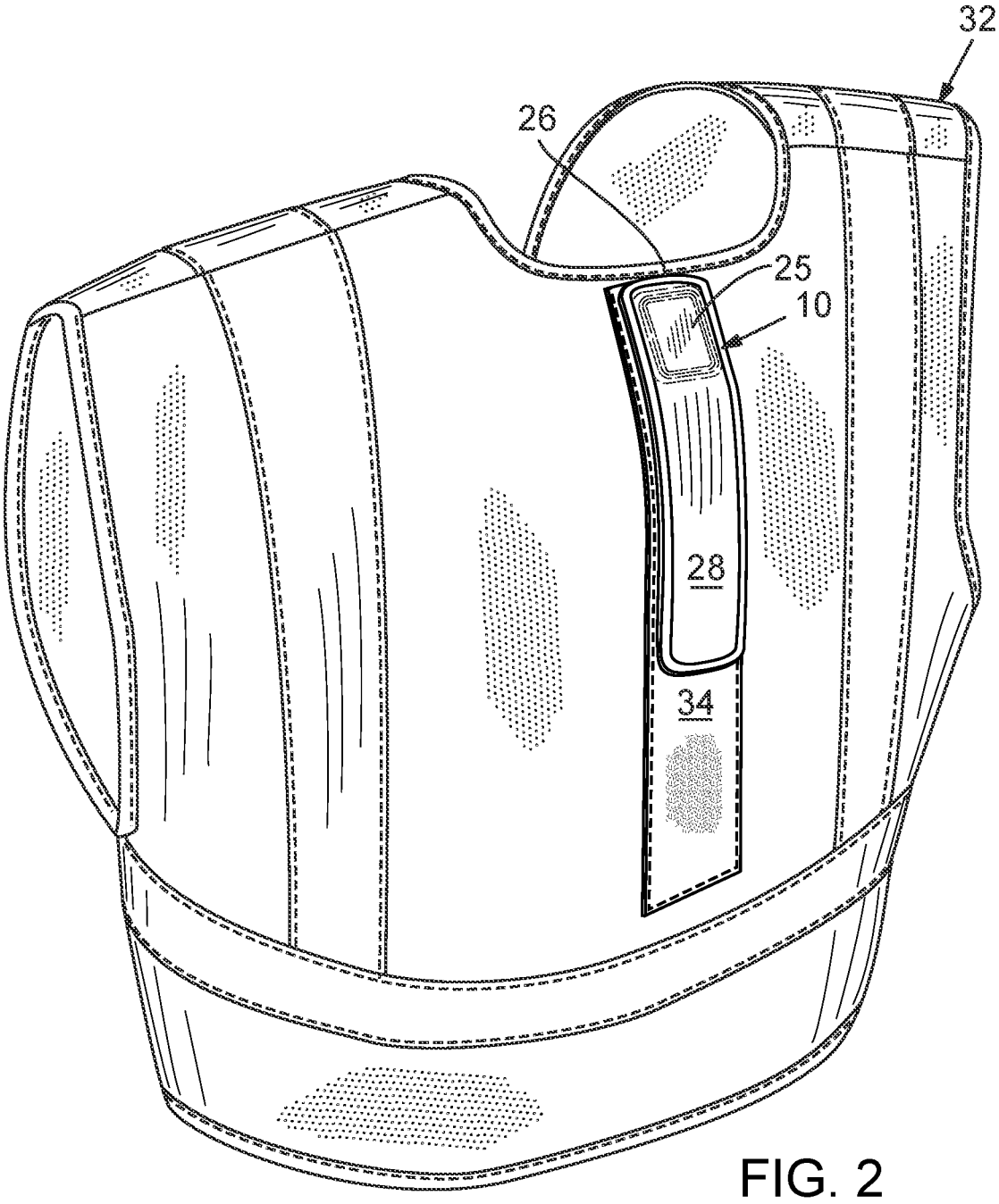
FIG. 2 is a perspective view of the embodiment of the vest with the flange light in place.
Figure 3:
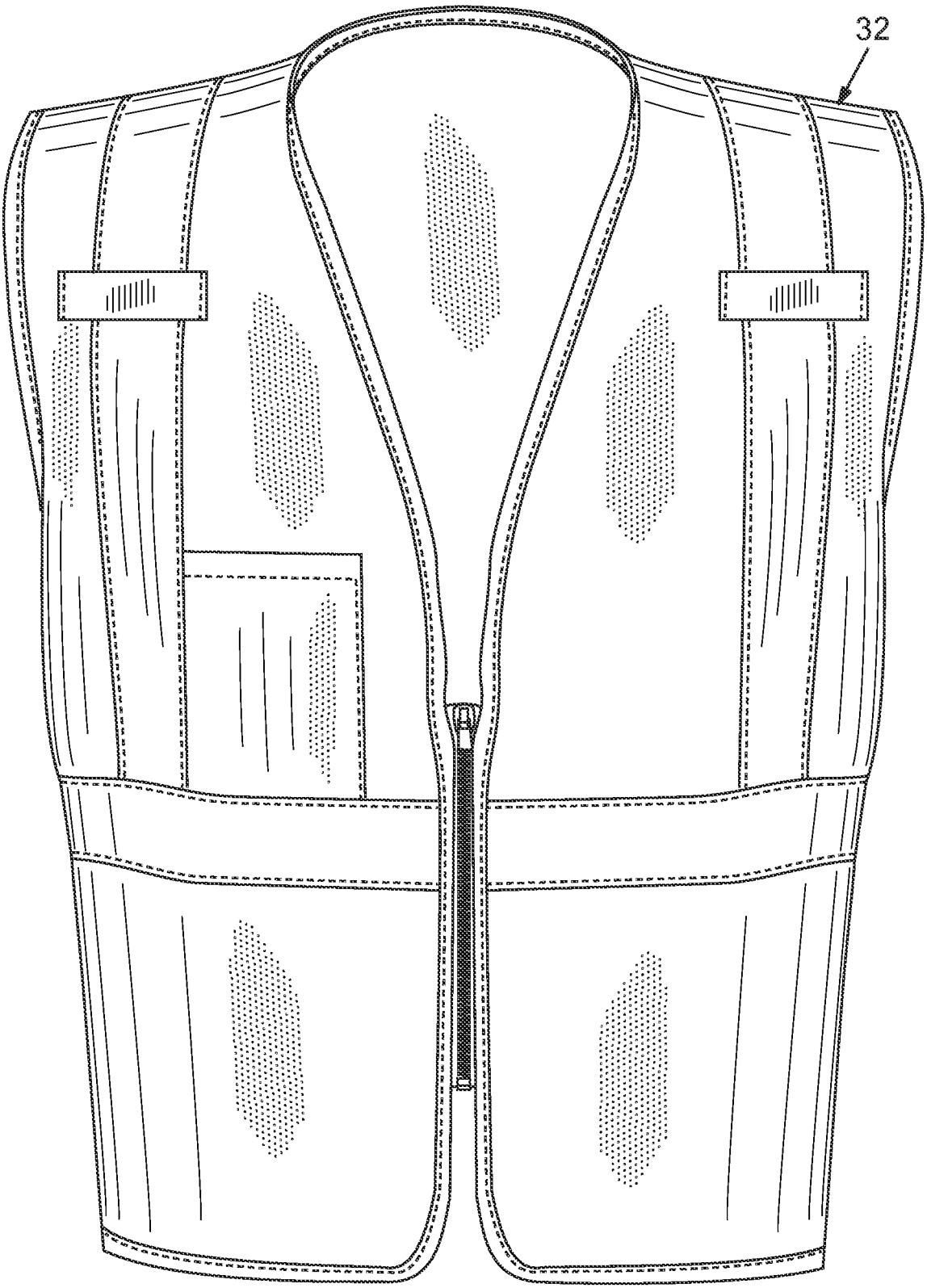
FIG. 3 is a front elevation view of the vest.
Figure 4:
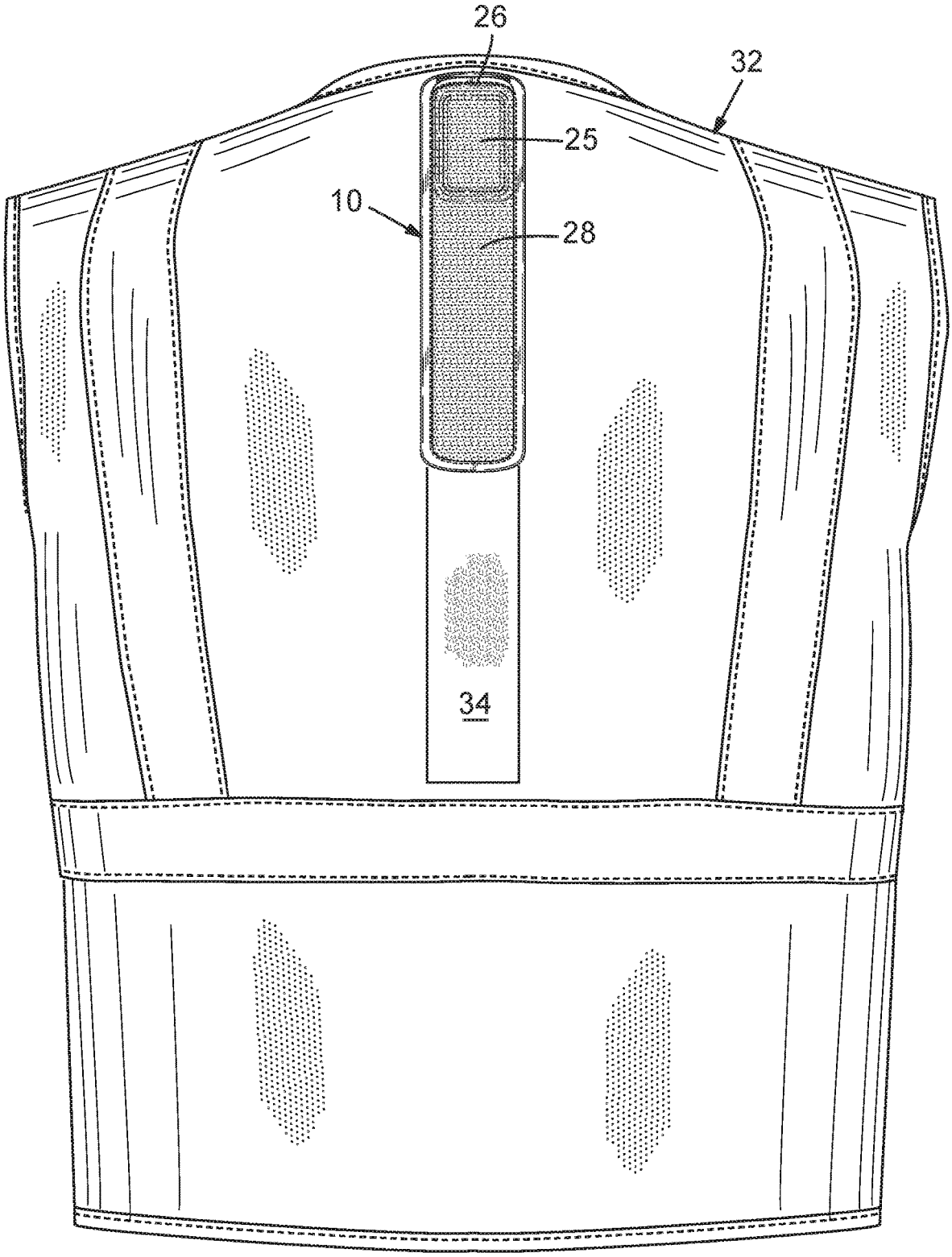
FIG. 4 is a rear elevation view of the vest with the flange light in place.
Figure 5:
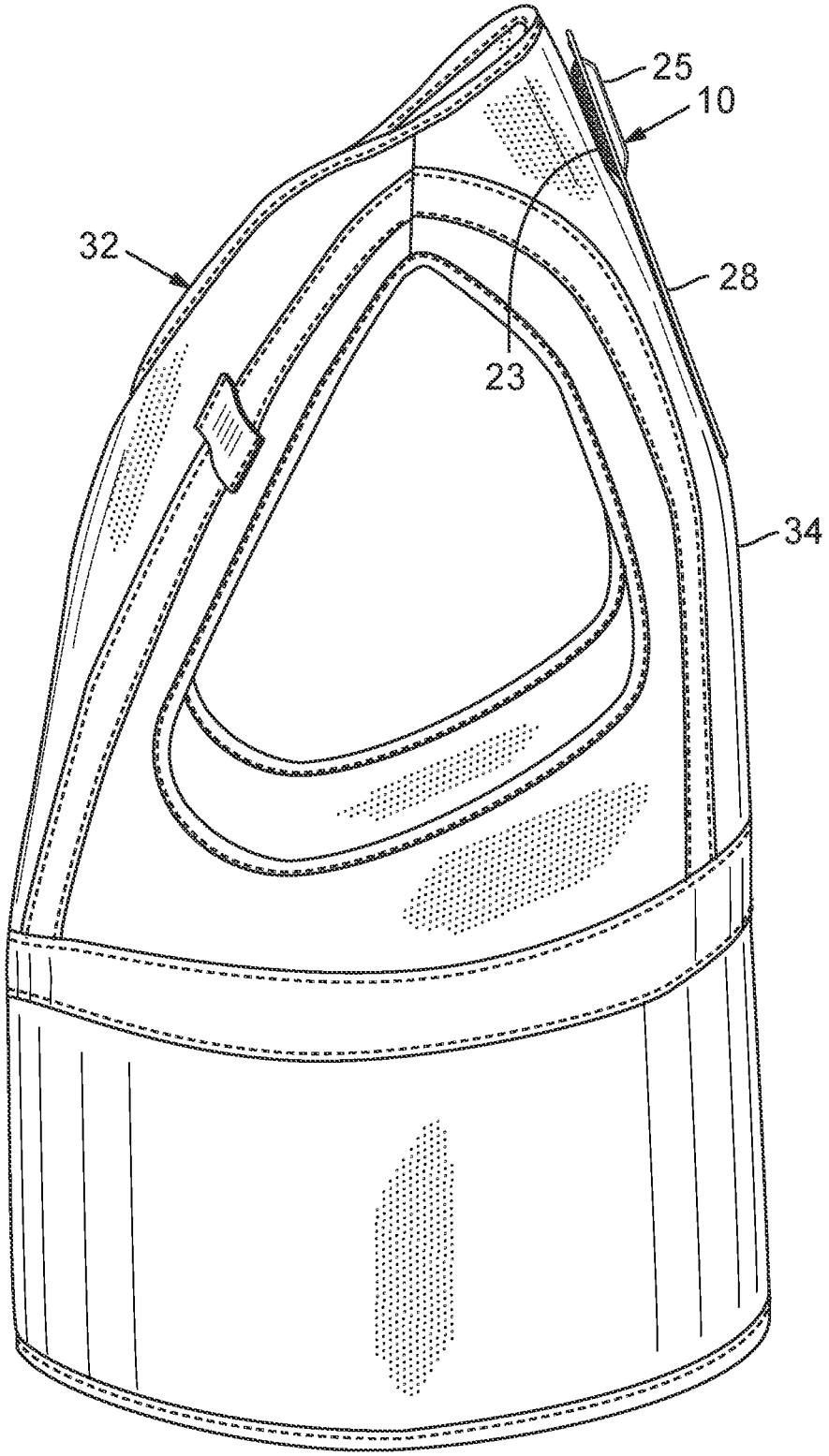
FIG. 5 is a side elevation view of the vest from the left side with the flange light in place.
Figure 6:
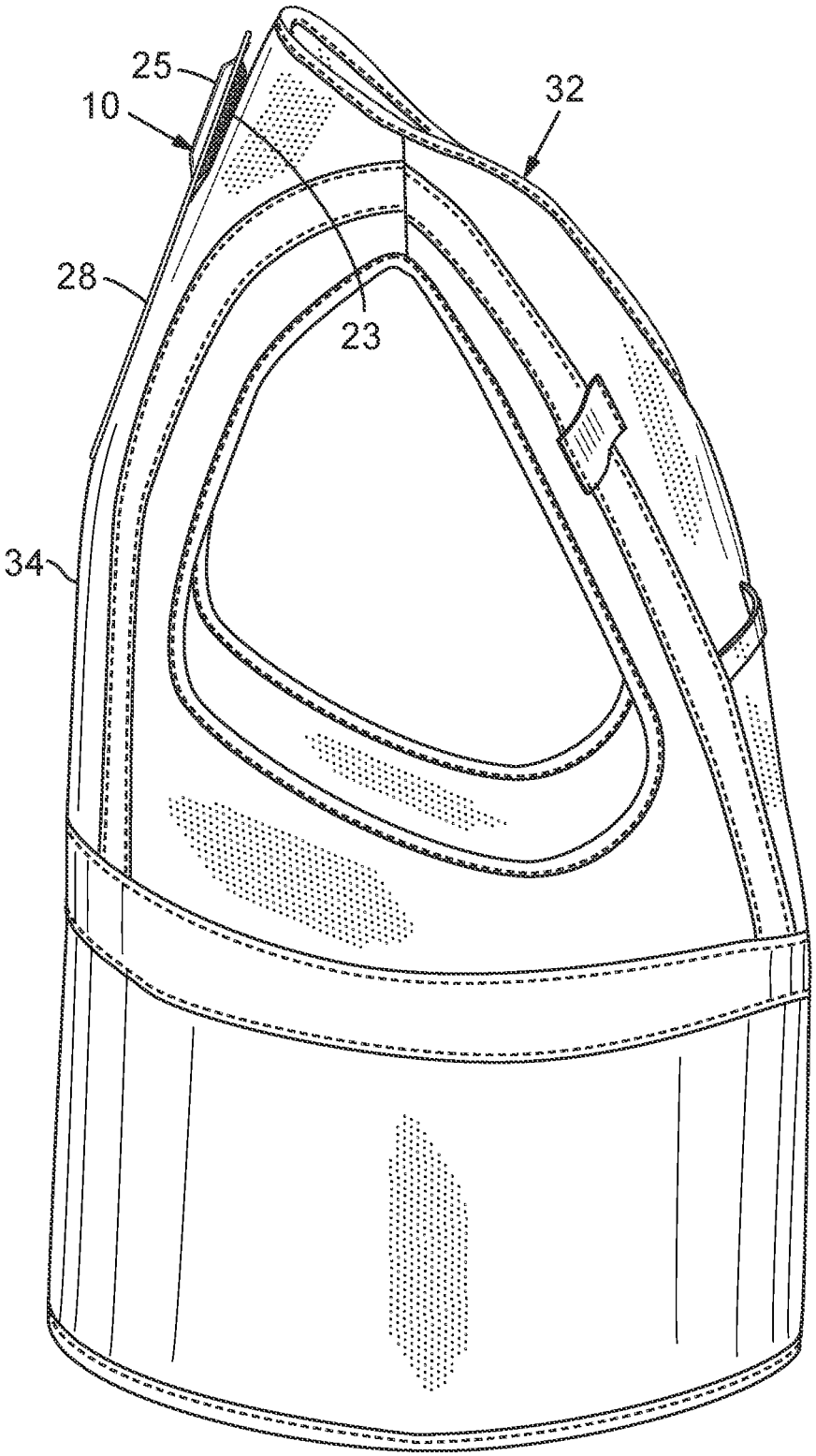
FIG. 6 is a side elevation view of the vest from the right side with the flange light in place.
Figure 7:
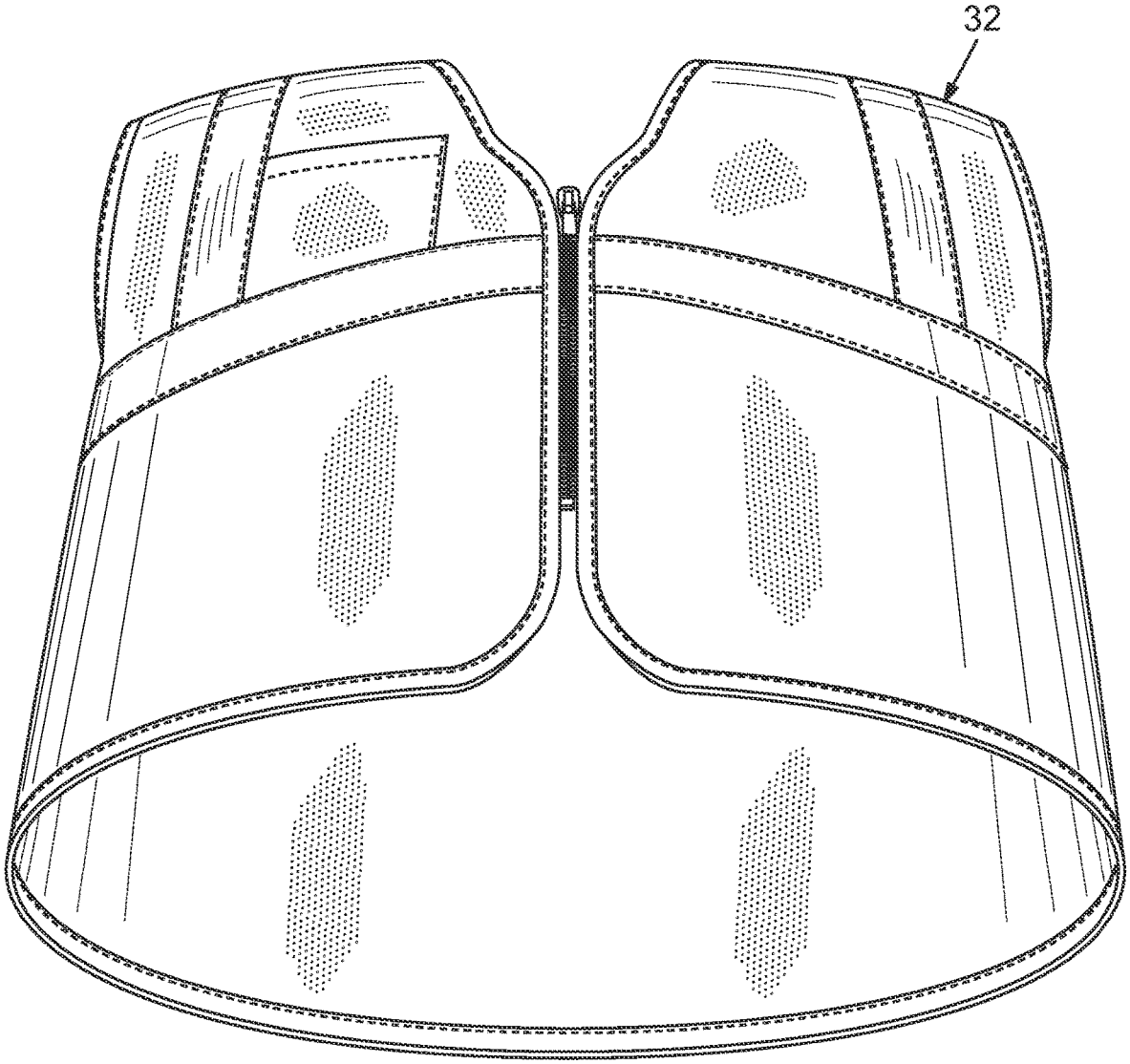
FIG. 7 is a perspective view of the vest from a lower, front angle.
Figure 9:
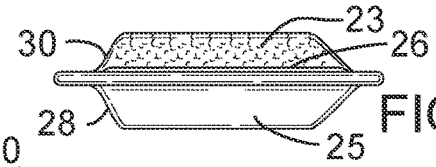
FIG. 9 is a top view of the flange light mounted in the pocket ready to be mounted to the vest.
Figure 11:
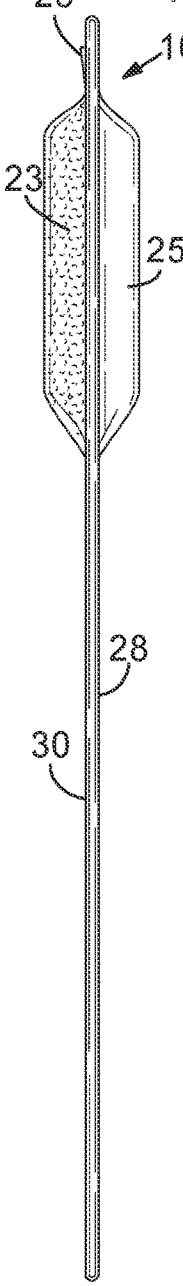
FIG. 11 is a side elevation view of the flange light mounted in the pocket ready to be mounted to the vest, taken from the left side.
Figure 8:
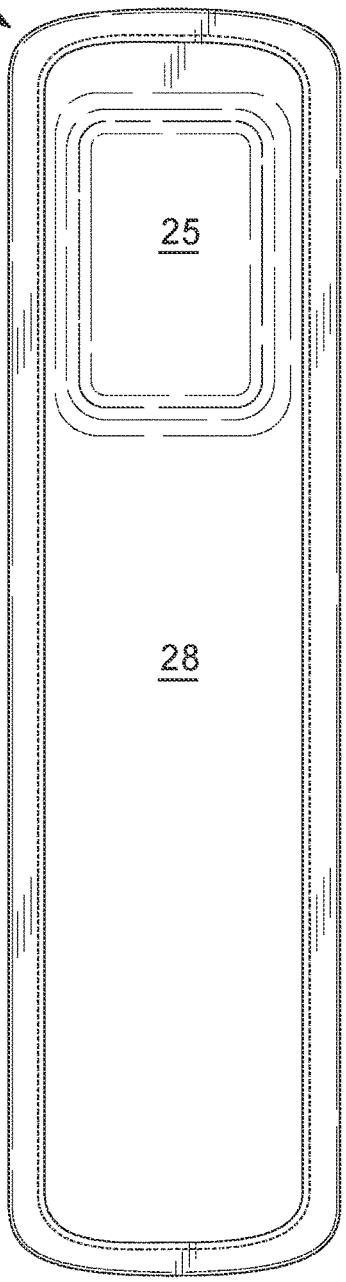
FIG. 8 is a front elevation view of the flange light mounted in a pocket, ready to be mounted to the vest.
Figure 12:
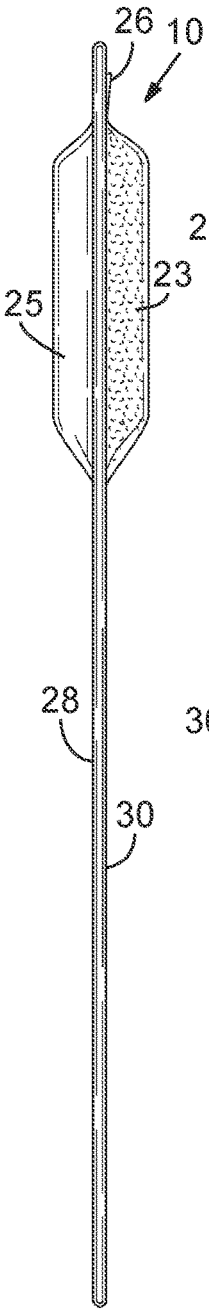
FIG. 12 is a side elevation view of the flange light mounted in the pocket ready to be mounted to the vest, taken from the right side.
Figure 13:
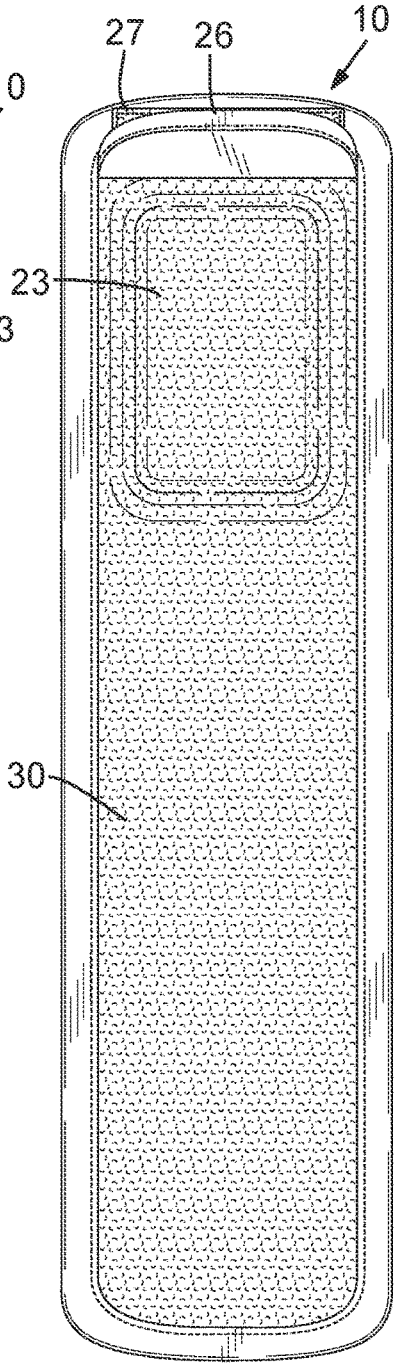
FIG. 13 is a rear elevation view of the flange light mounted in the pocket ready to be mounted to the vest.
Figure 10:
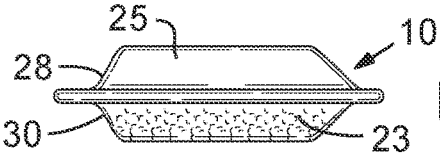
FIG. 10 is a bottom view of the flange light mounted in the pocket ready to be mounted to the vest.
Figure 14:
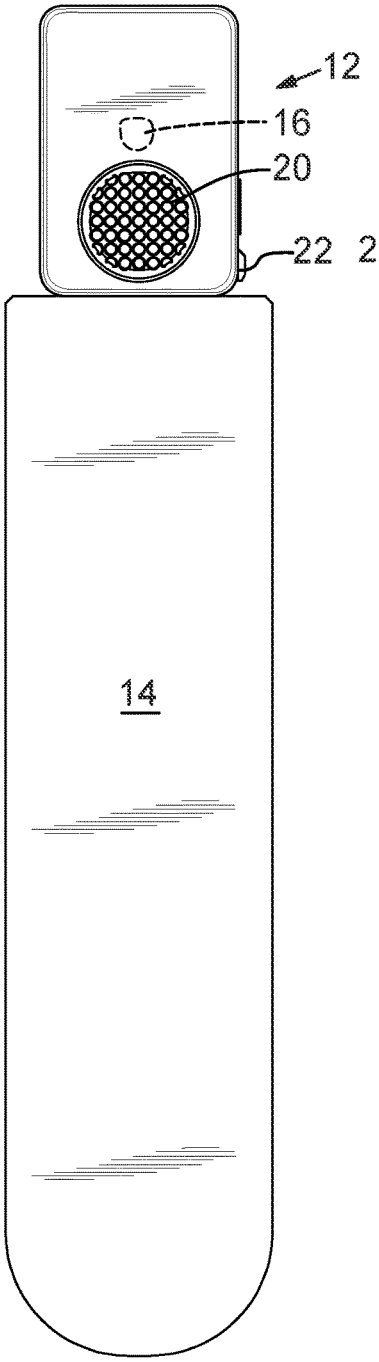
FIG. 14 is a front elevation view of an embodiment of the flange light.
Figure 15:
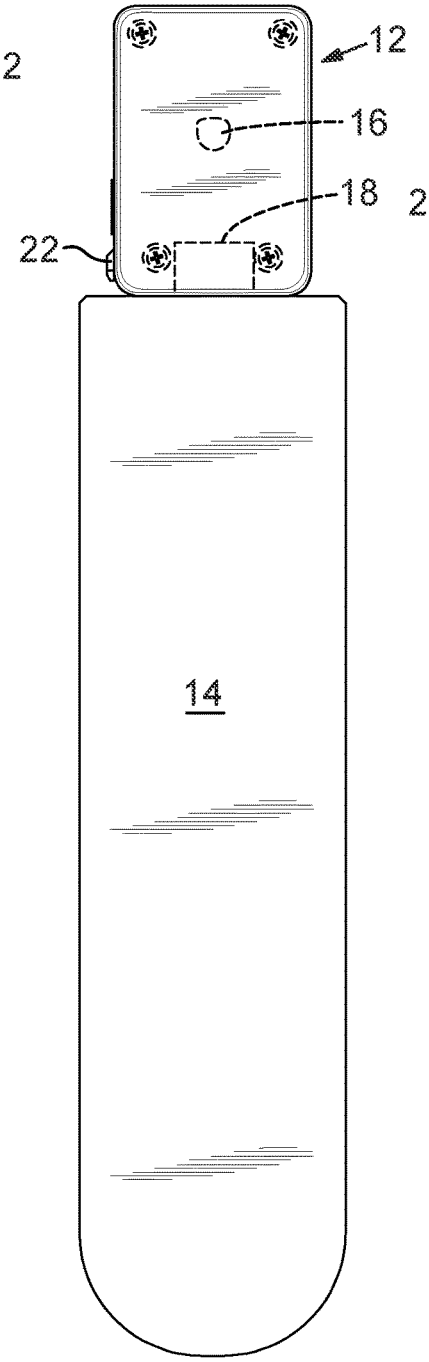
FIG. 15 is a rear elevation view of the embodiment of the flange light.
Figure 16:
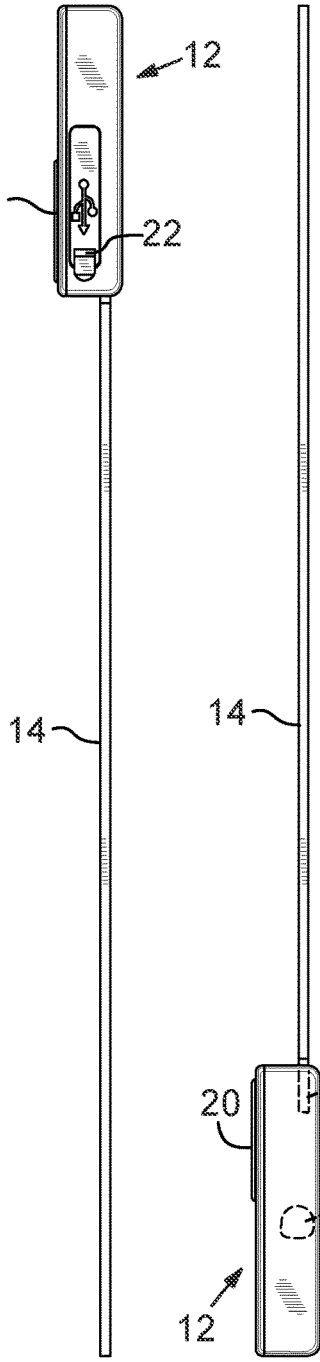
FIG. 16 is a side elevation view of the embodiment of the flange light, taken from the left side.
Figure 17:
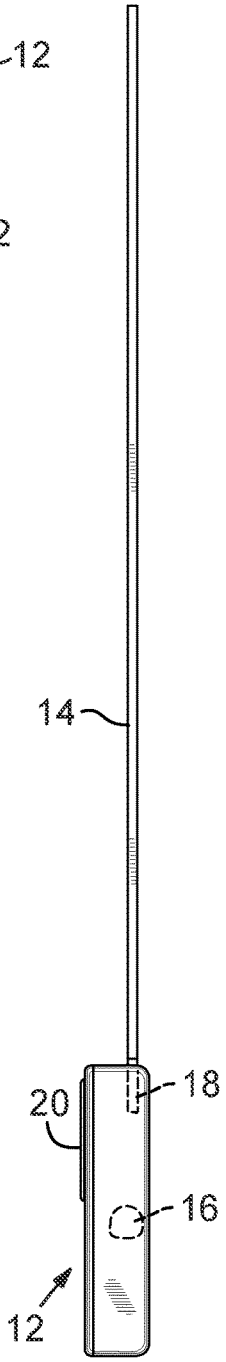
FIG. 17 is a side elevation view of the embodiment of the flange light, taken from the right side.
Figure 18:
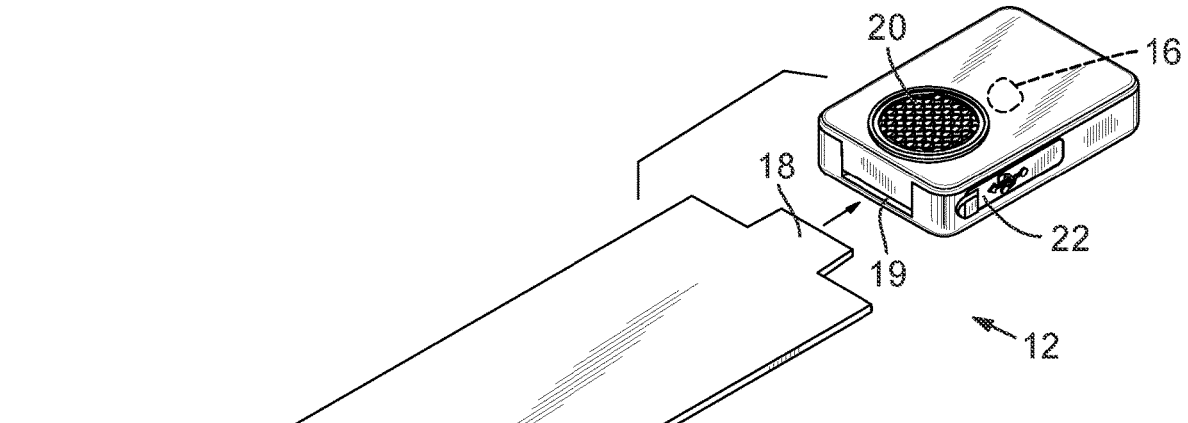
FIG. 18 is a perspective view of the embodiment of the flange light with the flat member removed from the light source.
Figure 19:
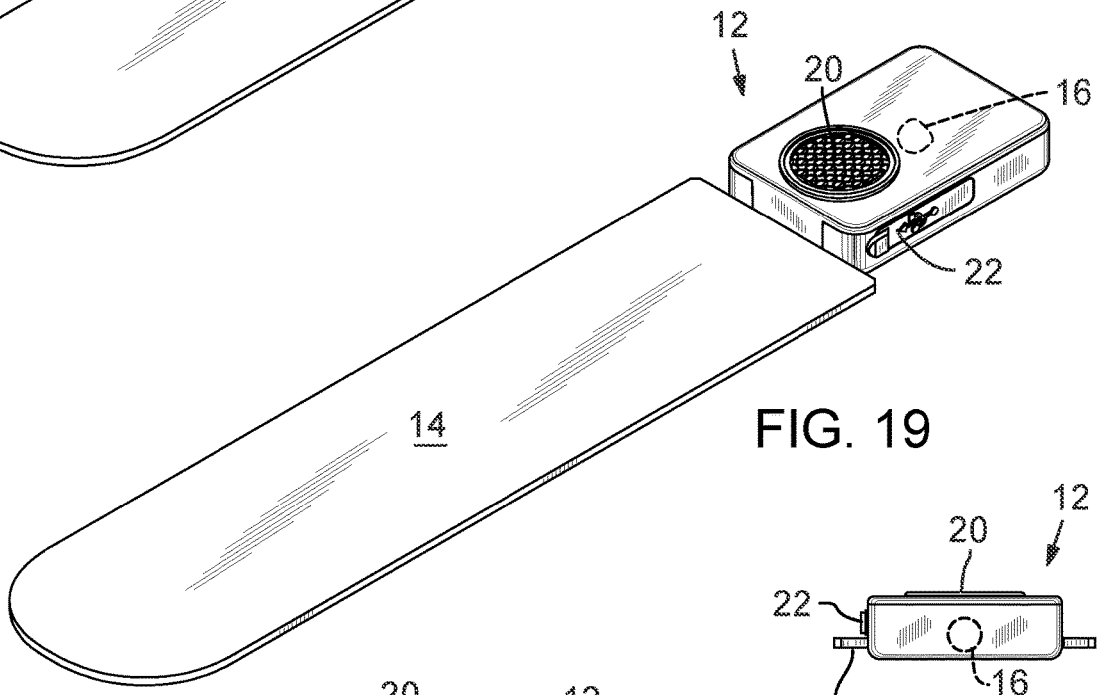
FIG. 19 is a perspective view of the embodiment of the flange light with the flat member inserted into the light source.
Figure 21:
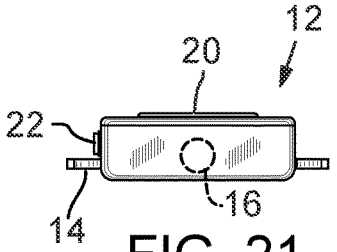
FIG. 21 is an end elevation view of the embodiment of the flange light, taken from the end of the light source.
Figure 20:
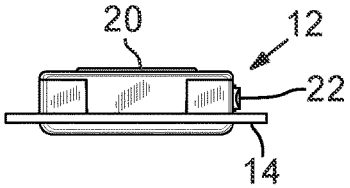
FIG. 20 is an end elevation view of the embodiment of the flange light, taken from the end of the flat member.

FIGS. 1-21 best depict an embodiment of the flange light of the present disclosure. The flange light is indicated generally at 10 in FIGS. 1 to 7 show it being mounted to the back of a safety vest 32. As shown in FIGS. 14-21, flange light 10 includes a light source 12 and a flat member 14. Light source 12 may include one or more LEDs, indicated schematically at 16, to generate light to be shown onto flat member 14. For this reason, flat member 14 typically includes a narrowed portion 18 that extends into a slot 19 in light source 12. Thus, LED 16 can shine onto narrowed portion 18, which causes the entire flat member 14 to light up.

Light source 12 includes an on/off switch 20 and a UBS charging port 22, as the light source typically includes rechargeable batteries. Light source 12 is typically fairly small so that it can fit into a pocket shown generally at 24 in FIGS. 8-13. Pocket 24 includes a flap 26, which permits pocket 24 to be opened to permit insertion of flange light 10. Flap 26 may include Velcro on one side and may be held in a closed position by a complementing Velcro surface 27. At least an outer side 28 of pocket 24 is typically at least translucent, so that light from flat member 14 can shine through the outer side. The term "at least translucent" means that it is translucent or transparent such that light can shine through it. While typically translucent, this outer side 28 is typically colored a bright translucent color such as orange, red or yellow, colors used to provide a warning to anyone coming upon someone wearing vest 32.

FIGS. 8-13 show bulges on both sides of the pocket, with inner bulge being identified at 23 and outer bulge being identified at 25. These bulges form as flap 26 is pulled away from Velcro 27 and flange light 10 is slid into pocket 24. The rest of pocket 24 is quite thin as it holds flat member 14, which is typically very thin as well. The bulges 23 and 25 also appear in FIGS. 5 and 6, with the flange light 10 mounted to vest 32.

As noted, outer side 28 of pocket 24 is typically translucent while an inner side 30 is typically covered in Velcro so that it may be mounted by simply pressing the inner side of pocket into a portion 34 of vest 32 that is typically also covered in Velcro. It is not necessary that the entire back surface 30 of pocket 24 be covered in Velcro. Nor is it necessary that the entire portion 34 be covered in Velcro. However, by covering the surfaces as depicted, the person wearing the vest has maximum flexibility in positioning light 10 where he or she would like. In the figures, the light is shown mounted high on the shoulders but by providing a long Velcroed portion 34, the light may be positioned high or low. Alternate systems for removably mounting the flange light to the vest may alternatively be used, such as magnets or snaps.

Vest 32 is largely conventional, with a vest body shaped to the body of the typical wearer, including a front, back and sides. In addition to being designed to receive flange light 10, vest 32 typically includes vertical, horizontal and crossed reflective portions shown in FIGS. 1-7.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A safety vest comprising:

a vest body including front, back and sides;

a light source including:

a battery pack with at least one LED within a housing of the battery pack; and a flat member that extends from the battery pack, wherein a portion of the flat member extends through a slot in the housing to be in proximity to the at least one LED such that light shining from the LED onto the portion of the flat member will light up the flat member;

wherein the light source is removably mounted to the vest body such that the flat member provides a safety light mounted to the vest.

2. The safety vest of claim 1 wherein the light source is removably mounted into a pocket in the vest body such that a layer of at least translucent fabric is disposed over the flat member when the light source is mounted in the vest body.

3. The safety vest of claim 1 wherein the flat member is a transparent piece of plastic.

4. The safety vest of claim 1 wherein the flat member is mounted to the vest body by Velcro.

5. The safety vest of claim 1 wherein the flat member is elongate and the portion that extends into the battery pack is narrower than a body of the flat member.

6. The safety vest of claim 1 further comprising a pocket into which the light source may be removably inserted, the pocket including an open end and a closed end, one side having a covering thereon that is at least translucent, and one side having a removable mounting system thereon for removably mounting the pocket to the vest body.

7. A light for illuminating a safety vest, the light comprising:

a light source including:

a battery pack with at least one LED; and a flat member that extends from the battery pack and is mounted in proximity to the at least one LED such that light shining from the LED onto the flat member will light up the flat member;

a pocket into which the light source may be removably inserted, the pocket including an open end and a closed end, one side having a covering thereon that is at least translucent, and one side having a removable mounting system thereon for removably mounting the pocket to a safety vest.

8. The light of claim 7 wherein the flat member is elongate with a narrowed portion that extends into the battery pack to a point adjacent the LED.

9. The light of claim 7 wherein the removable mounting system comprises Velcro.

* * * * *